United States Patent [19]

Buchanan

[11] 4,406,071

[45] Sep. 27, 1983

[54] PORTABLE GARMENT DRYER

[76] Inventor: Robert H. Buchanan, 102 - 2445 Cornwall St., Vancouver, British Columbia, Canada, V6K 1B9

[21] Appl. No.: 332,378

[22] Filed: Dec. 21, 1981

[51] Int. Cl.[3] ..... F26B 19/00

[52] U.S. Cl. ..... 34/91; 34/243 R; 428/35; 428/134

[58] Field of Search ..... 428/35, 134; 34/243 R, 34/239, 343 R, 91, 97; 219/373

[56] References Cited

U.S. PATENT DOCUMENTS

| | | | |
|---|---|---|---|
| 2,048,217 | 7/1936 | Peterson | 219/373 X |
| 2,260,687 | 10/1941 | Lasha | 34/202 |
| 2,573,214 | 10/1951 | Moran | 34/243 R |
| 3,509,637 | 5/1970 | Collier | 34/22 |
| 3,577,650 | 5/1971 | Brahm | 34/151 |
| 3,892,047 | 7/1975 | Muller-Scherak | 34/239 X |
| 3,905,125 | 9/1975 | Hubner | 34/239 X |
| 3,986,272 | 10/1976 | Feierabent | 34/239 X |
| 4,094,076 | 6/1978 | Baslow | 34/239 X |
| 4,151,658 | 5/1979 | Hibino et al. | 34/243 R |
| 4,199,873 | 4/1980 | Hansen et al. | 34/91 X |

*Primary Examiner*—Henry F. Epstein
*Attorney, Agent, or Firm*—Carver & Co.

[57] ABSTRACT

Foldable garment dryer for use with a conventional hand-held hair dryer comprises a flexible bag for holding the garment. The air intake of the bag is connected to the air outlet nozzle of the hair dryer, and the humid air is expelled out of the bag through an exhaust. A stand supports the hair dryer.

8 Claims, 4 Drawing Figures

PORTABLE GARMENT DRYER

BACKGROUND OF THE INVENTION

1. Field of the Invention

The invention relates to a foldable device for drying garments, such as women's pantyhose, for use with a conventional handheld hair dryer having an air outlet nozzle.

2. Prior Art

U.S. Patent Specification No. 4,199,873 to Hansen discloses an apparatus for drying small laundered garments, such as women's pantyhose, comprising a box-like compartment through which hot air is delivered by a conventional portable hair dryer. The walls of the compartment are connected by hinges so that the device may be folded down to a flat configuration when not in use.

This apparatus being made of rigid material like cardboard cannot be bent and conveniently stored in flexible travel bags during travel due to its appreciable surface area in its folded down configuration. Frequent use subjects the apparatus to wear and tear with subsequent deterioration.

SUMMARY OF THE INVENTION

It is an object of the invention to provide a foldable device for drying garments that uses very little space in travel bags and can suffer a lot of abuse without the risk of damage. It is a further object of the invention to provide a device that is extraordinarily inexpensive and easy to manufacture.

According to the invention, the foldable device for drying garments, such as women's pantyhose, for use with a conventional hand-held hair dryer having an air outlet comprises a flexible bag for enclosing the garment to be dried. The bag has an opening for receiving the garment, closure means for releasably restricting the size of the opening to confine the garment inside the bag during the drying operation, and intake means for receiving air from the hair dryer. The bag further has connecting means for connecting the intake means with the outlet nozzle of the hair dryer and exhaust means for expelling the humid air from the bag.

A detailed description following related to the drawings gives exemplification of structure according to the present invention which, however, can be expressed by means other than those particularly described and illustrated.

DETAILED DESCRIPTION

Figure 1:
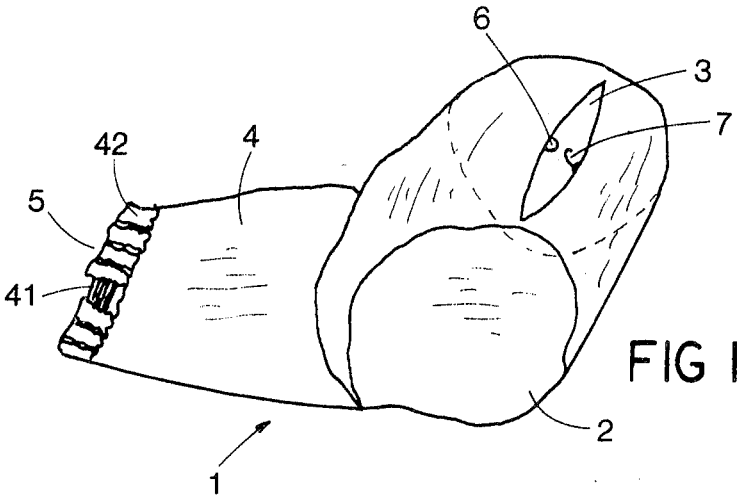
FIG. 1 is a simplified diagrammatic view of a flexible bag according to the invention, for holding the garment to be dried.

FIG. 1 shows a flexible and foldable bag 1 made of a suitable fabric, such as nylon (registered trade mark). The bag comprises a barrel-shaped main body 2 for holding the garment to be dried, which garment is placed into the bag through a slot 3. The bag further comprises a sleeve portion 4 having a circular air intake 5, which in the simplest embodiment of the invention is slipped directly onto the air outlet nozzle 20 of a conventional portable hair dryer 19 (the front part of which is shown broken away in FIG. 4). The bag adjusts to nozzles of various diameters by means of a rubber band 41 enclosed by stitching into the fabric adjacent the air intake 5 and shown in the broken away section of the mouth 42 of the sleeve portion 4. The slot 3 simultaneously serves as exhaust means for expelling the humid air from the bag. An eyelet 6 and hook 7 are attached adjacent opposite sides of slot 3 for closing the slot enough to prevent the garment from being blown out of the bag, whilst leaving sufficient room for the humid air to escape from the bag. Clearly the eyelet and hook combination can be replaced by equivalent fasteners like a snap fastener or button and hole combination. During the drying procedure the hair dryer is held by the hand of the user. It can also be supported by a stand supplied with the hair dryer or by a stand according to the invention as described below.

Figure 2:
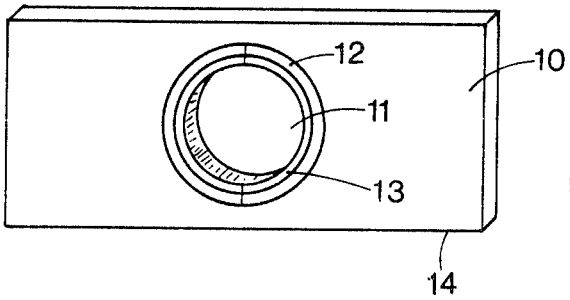
FIG. 2 is a simplified perspective view of a stand according to the invention.

FIG. 2 shows a stand for the hair dryer, so that it can be placed on a table or other suitable base during use. This stand comprises a support plate 10, preferably made of plastic, having an opening 11 for receiving the air outlet nozzle of the hair dryer. Around the opening 11 regions 12 and 13 of pre-determined weakness are provided, which can be broken away in order to enlarge the opening for adapting it to nozzles of larger diameters. The opening can be lined with resilient material such as rubber for improving the grip on the nozzle or the whole plate can be made of a material that has somewhat resilient properties.

For use, the air outlet nozzle 20 of the hair dryer 19 is passed through the opening 11 of the support plate 10 until it is firmly gripped by the support plate. The support plate is then placed on a table or other suitable base with its lower edge 14 resting thereon, which table also supports the hair dryer in such a position that its air intake openings are not covered. This would normally be a position with the handle of the hair dryer pointing upwards. The bag 1 is then attached to the air outlet nozzle 20 of the hair dryer protruding from the support plate 10 by slipping the mouth 42 of the sleeve portion 4 onto the air outlet nozzle, where it is held in position by means of the rubber band 41 adjacent the air intake 5.

Figure 3:
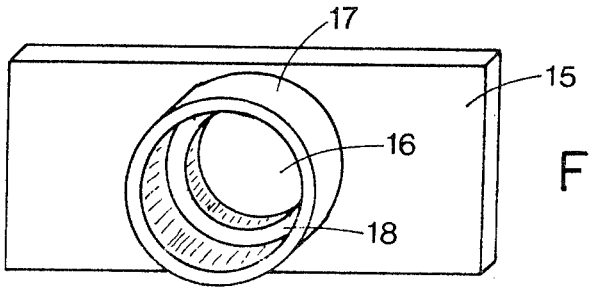
FIG. 3 is a simplified perspective view of a modified stand according to the invention.

FIG. 3 shows a modified support plate 15 having an opening 16 for receiving the air outlet nozzle of the hair dryer. Regions of pre-determined weakness (not shown) can also be provided around the opening 16 in the ring-shaped section 18. The support plate further comprises a tube-shaped extension 17 protruding perpendicular from the plane of the support plate 15. With this modified support plate 15, the mouth 42 of the bag 1 is not connected directly with the air outlet nozzle of the hair dryer, but with the extension 17. This has the advantage that the extension 17 has a constant diameter, which makes it easier to manufacture a bag with a proper fit no matter how different in diameter the air outlet nozzles of the hair dryers are that are to be used with the support plate 15.

The support plate according to FIGS. 2 and 3 are best suited to cooperate with air outlet nozzles tapering from a larger to a smaller diameter along their length. With strictly cylindrical air outlet nozzles, it is possible that these support plates do not grip the nozzles sufficiently to adequately support the hair dryer.

Figure 4:
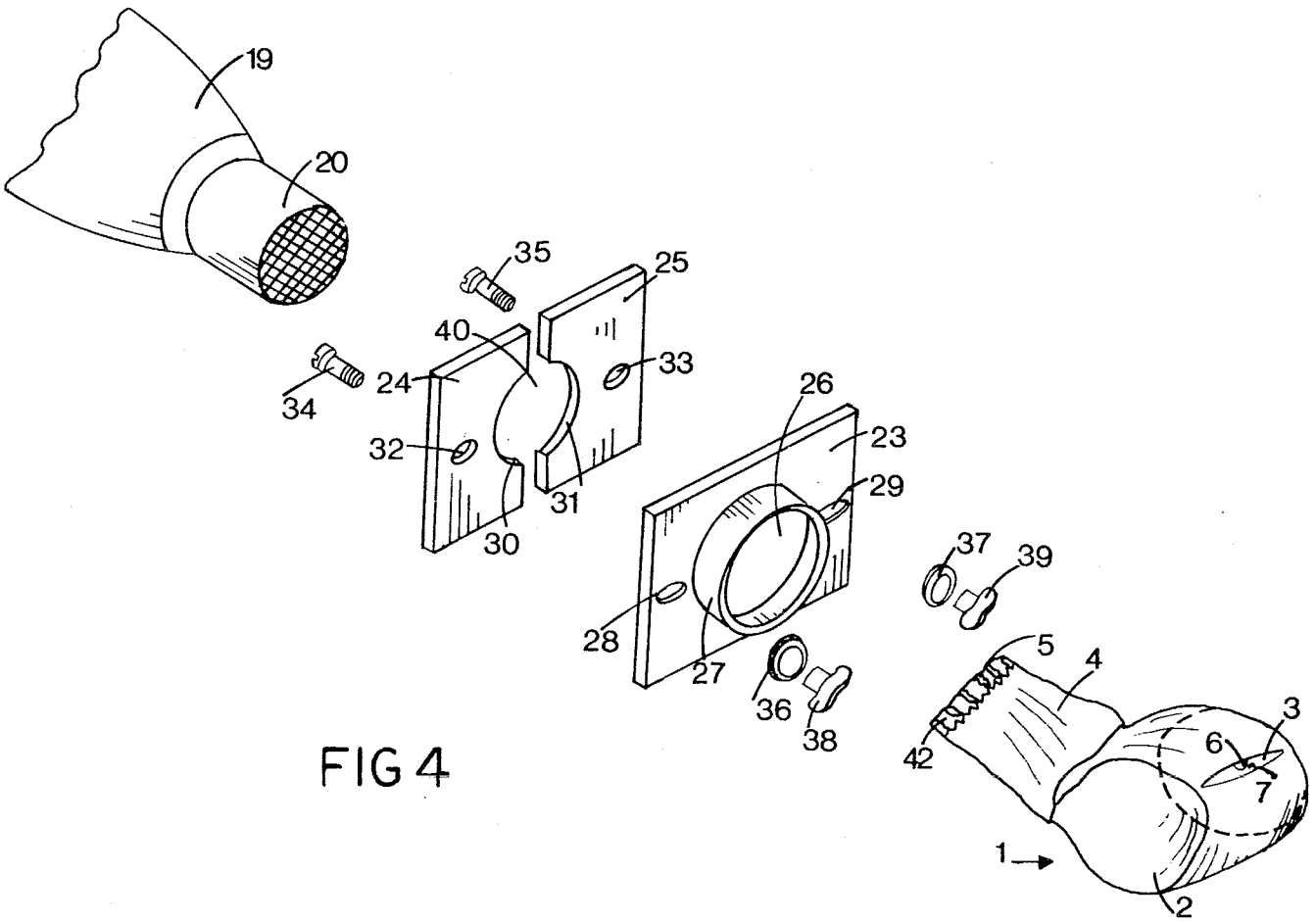
FIG. 4 is a simplified exploded view of the arrangement according to the invention with the bag shown in smaller dimensions compared to other parts of the drawing.

In order to deal with this situation, a modified support plate 23 cooperating with clamping means in the form of two clamping plates 24 and 25 is provided as shown in FIG. 4. The support plate 23 has an opening 26 large enough to accomodate the biggest air outlet nozzles of hair dryers in general use. This support plate further comprises an extension 27, which serves the same purpose as that described in conjunction with FIG. 3. The support plate 23 has elongated screw holes 28 and 29 diametrically spaced-apart on opposite sides of the extension 27.

The clamping plate 24 has a semi-circular cut-out 30 and a circular screw hole 32, and the clamping plate 25 has a correspondingly semi-circular cut-out 31 and circular screw hole 33. The semi-circular cut-outs can be surrounded by regions of pre-determined weakness (not shown) as described in conjunction with FIG. 2.

For use of the arrangement, screws 34 and 35 are passed through the circular screw holes 32 and 33 in the clamping plates 24 and 25 and through the elongated screw holes 28 and 29 in the support plate 23. Washers 36 and 37 and wing nuts 38 and 39 are placed onto the screws 34 and 35 and thereafter the wing nuts are at first tightened only to such an extent that the clamping plates can still be slidably moved with respect to each other over a distance determined by the length of the elongated screw holes 28 and 29. Now the air outlet nozzle 20 of the hair dryer 19 is passed first through the opening 40 formed by the semi-circular cut-outs 30 and 31 in the clamping plates 24 and 25 and thereafter through the opening 26 in the support plate 23. The clamping plates are now moved towards each other until they firmly grip the air outlet nozzle of the hair dryer whereafter the wing nuts are firmly tightened. Then the mouth 42 of the bag 1 with its air intake 5 is slipped over the extension 27. After placing a garment to be dried through the slot 3 into the barrel-shaped main body 2 of the bag 1 and closing the eyelet and hook combination 6 and 7, the device is ready for use.

I claim:

1. A foldable device for drying garments, such as womens' pantyhose, for use with a conventional hand-held dryer having an air outlet nozzle, comprising:

(a) a main large, hollow flexible receiving bag made of fabric material, (b) a flexible air intake sleeve made of fabric material connected to one side of the receiving bag for supplying hot air thereto, (c) the other end of the sleeve having retaining means for adjustably closing that end of the sleeve about the nozzle of a hair dryer, (d) a large garment receiving opening extending transversely across substantially the entire width of the bag and disposed toward the other side of the bag which is away from the connection of the air intake sleeve, the opening being sufficiently large for receiving the garment to be dried, (e) closure means associated with the garment receiving opening for partially restricting the size of the opening to confine the garment inside the receiving bag during the drying operation and for simultaneously permitting the expelling of humid air from the receiving bag.

2. A device as claimed in claim 1, wherein the closure means is at least one hook and eyelet combination.

3. A device as claimed in claim 1, wherein the connecting means is a rubber band attached adjacent the intake means.

4. A device as claimed in claim 1, further comprising a stand for receiving the outlet nozzle of the hair dryer for supporting the hair dryer.

5. A device as claimed in claim 4, wherein the stand is a support plate standing on one edge and having an opening adapted to receive the outlet nozzle of the hair dryer.

6. A device as claimed in claim 5, wherein the support plate is provided with clamping means for gripping the outlet nozzle of the hair dryer.

7. A device as claimed in claim 6, wherein the clamping means comprises two clamping plates arranged side by side each having a semi-circular cut-out on adjacent sides, the clamping plates being slidably connected to the support plate and adapted to be fixed in a position, where the faces of the cut-outs grippingly hold the outlet nozzle of the hair dryer.

8. A device as claimed in claim 5 or 6, wherein the support plate has a tube-shaped extension protruding perpendicular from the plane of the support plate, for receiving the connecting means.

* * * * *